United States Patent [19]

Ness

[11] 4,235,389

[45] Nov. 25, 1980

[54] PAPER TOWER HOLDER AND THE LIKE

[76] Inventor: Virginia V. Ness, 57 W. Shore Rd., Belvedere, Calif. 94920

[21] Appl. No.: 49,236

[22] Filed: Jun. 18, 1979

[51] Int. Cl.[3] ..... B65H 19/02

[52] U.S. Cl. ..... 242/55.2; 242/129.7; 242/130; 242/141

[58] Field of Search ..... 242/55.2, 55.55, 55.54, 242/55.3, 129.5, 129.7, 129.71, 129.72, 129.8, 130, 130.1, 130.2, 130.3, 130.4, 131, 134, 141, 46.2, 46.21, 46.3, 46.6

[56] References Cited

U.S. PATENT DOCUMENTS

| | | | |
|---|---|---|---|
| 438,854 | 10/1890 | Miller | 242/134 |
| 734,293 | 7/1903 | Bates et al. | 242/141 |
| 1,825,822 | 10/1931 | Rundell | 242/55.2 |
| 1,851,722 | 3/1932 | Moore | 242/55.2 |
| 2,515,990 | 7/1950 | Dantzler | 242/55.2 |
| 2,928,618 | 3/1960 | Locke | 242/55.54 |
| 3,294,352 | 12/1966 | Leonard | 242/130.3 X |

FOREIGN PATENT DOCUMENTS

| | | | |
|---|---|---|---|
| 1924371 | 11/1970 | Fed. Rep. of Germany | 242/130.1 |
| 581770 | 10/1924 | France | 242/129.7 |

*Primary Examiner*—Stanley N. Gilreath

*Attorney, Agent, or Firm*—Owen, Wickersham & Erickson

[57] ABSTRACT

A holder for paper towels and the like. A standard extends from the side of a flat base and is integral therewith. A major portion of the standard comprises four radially outwardly-extending strips extending out at ninety-degree intervals from a common center, the outer edges of all strips tapering together outwardly from a widest portion at the base. A minor portion distant from the base comprises an extension of each of the four strips, with them separated from each other at the center by a gradually increasing amount. The strips can be forced in toward the center with springy resilience tending to restore them to a normal outward position. Each strip terminates at an out-turned finial. A roll of paper can be placed on the standard by urging the finials inward and then pushing the paper roll toward the base until the finials emerge from the opposite end of the roll and by spring-action expand to overlie and engage the end of the paper roll and retain it in place on the standard, the standard then retaining the paper roll rotatably but with some braking force thereon. If desired, an outer tubular cap may be put in place for engagement with the finials and adjacent the paper roll.

5 Claims, 7 Drawing Figures

PAPER TOWER HOLDER AND THE LIKE

BACKGROUND OF THE INVENTION

This invention relates to a holder for a roll of paper, such as a paper-towel roll or a toilet-paper roll.

Most current paper-towel holders are, to some degree at least, unsatisfactory. Either they must be placed horizontally with the use of considerable apparatus or else they require two-hand operation during use, or both.

An important object of the present invention is to provide a holder for paper towels and other rolls of paper which can be held on any suitable horizontal or vertical surface, holding the paper towel vertically if placed on an horizontal surface or horizontally if secured to a vertical surface, The device may be secured to a wall beneath a counter or may be secured to the counter itself below the counter or it may be placed on top of the counter or at a wall in any other location.

Another object of the invention is to provide a paper-roll holder in which the roll is very easily installed and removed. In the present invention installation takes at the most a few seconds.

Another object of one form of the invention is to provide a one-piece towel holder which can be molded as by injection molding from a suitable high-impact plastic without any parts to assemble. It may then be supported by screws or by adhesive adhered to the opposite side of the base from the projection.

In another form of the invention, a two-piece structure is used.

SUMMARY OF THE INVENTION

The invention comprises a preferably unitary member of high-impact plastic, such as polystyrene, having a flat base which is preferably circular, from which extends a projection or standard. The base is preferably circular, and the opposite side may be used for a double-face adhesive to secure it in place, or the base may be provided with screw holes and fastened to an horizontal or vertical surface by screws.

The projection or standard comprises a series of strips, preferably four, extending out radially from a common center. The strips are all of the same width at any place along any plane which is parallel to the base. However, their width narrows from being wide at the base to much narrower away from the base, so that at the bottom the radial width of the standard is wider than any paper roll with which it is to be used, while at the top it will be narrower than any such roll.

At an outer portion, the strips diverge from each other and there is a hollow center, the distance between the strips gradually increasing with the distance from the base. This enables the strips to be pushed in toward each other when inserting the roll of paper, and they flex out naturally with a spring-like force. At the top of each strip is a finial which can be forced into the center of the roll during installation and then when the roll has been installed, they emerge from the outer end of the roll. The finials then retain the roll in place, especially when the roll is being used in an horizontal configuration.

If desired, there may also be a tubular cap to fit inside the roll and over its outer end, retained in place by the finials.

DESCRIPTION OF A PREFERRED EMBODIMENT

Figure 1:
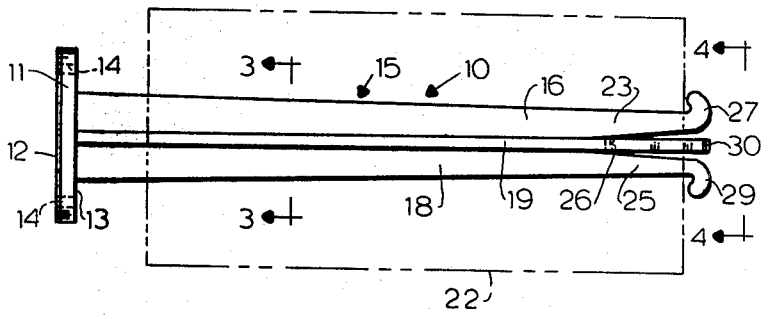
FIG. 1 is a view in side elevation of a paper-roll holder embodying the principles of the invention. A paper roll is indicated thereon by broken lines.
Figure 2:
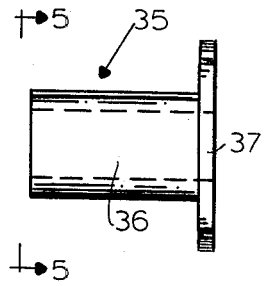
FIG. 2 is a view in side elevation of a tubular cap which may be used in conjunction with the device of FIG. 1.
Figure 3:
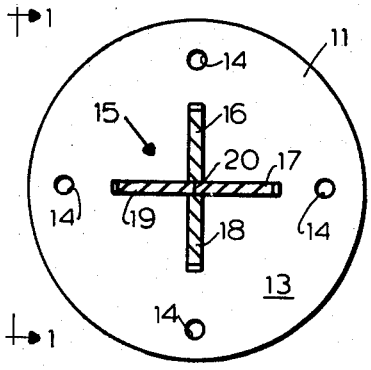
FIG. 3 is an enlarged view in section taken along the line 3—3 in FIG. 1.

The device comprises either a single member or a pair of members. In both instances, there is a main member 10 having a flat base portion 11, which is preferably a circular disc having a pair of surfaces 12 and 13. It may also be provided with screw openings 14, or it may be imperforate and installed solely by adhesive affixed to the surface 12.

Figure 4:
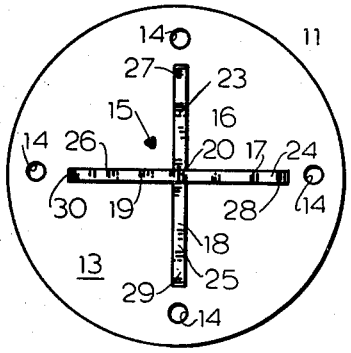
FIG. 4 is an enlarged view in end elevation taken along the line 4—4 in FIG. 1.
Figure 5:
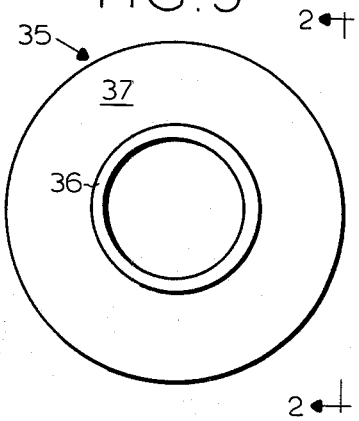
FIG. 5 is an end view taken along the line 5—5 in FIG. 2.

From the base 11*a*, preferably integral, protrusion or standard 15 is provided. Preferably, this comprises a set of outwardly-extending strips, preferably four strips 16, 17, 18, and 19, at 90° to each other, around a common center portion 20. The holder 10 is preferably molded, as by injection molding, from a suitable plastic, such as high impact polystyrene. At the base 11 strips 16, 17, 18, and 19 are wide; and they each are tapered or sloped so that at near their outer ends they are much narrower. At any one location, a plane parallel to the base 11 intersecting the standard 15 would find the four strips 16, 17, 18, and 19 to be of identical width. The structure is such that at the base 11 the four strips define two diametral lines which are wider in diameter than the diameter of the core 21 of any paper roll 22 to be used, while at the outer end the strips 16, 17, 18, and 19 are either narrower or capable of being made narrower, as will be described, than the inside of the core 21 of any paper roll 22 to be used. For this purpose, at their outer ends, the four strips 16, 17, 18, and 19 have portions 23, 24, 25, and 26 that diverge from each other, as shown in FIGS. 1 and 4, especially, and each strip ends in a radially outwardly-extending finial or locking portion 27, 28, 29, or 30. This means that the four strip portions 23, 24, 25, and 26 can be forced inward toward each other so that the finials 27, 28, 29, and 30 can enter the core 21 of the paper roll 22, and then when the paper roll 22 is installed, they will , due to their natural springiness, extend back and grip the roll 22 at its outer end.

Figure 6:
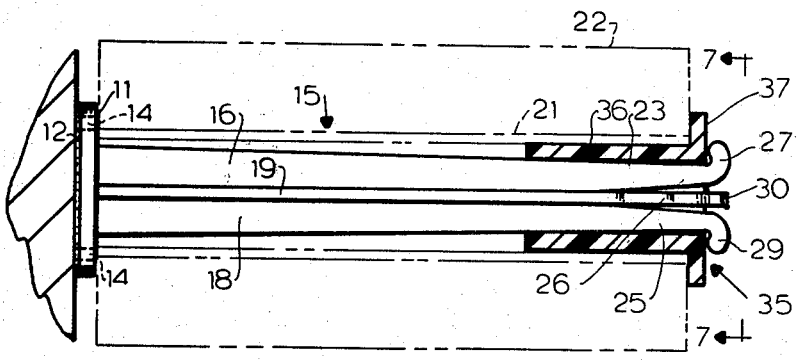
FIG. 6 is a fragmentary view of a wall with the towel holder installed thereon and a roll of paper towels installed there, this assembly including the cap of FIG. 2.
Figure 7:
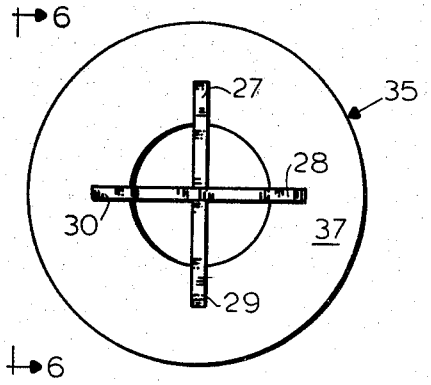
FIG. 7 is a view in end elevation taken along the line 7—7 of FIG. 6.

In some circumstances, there is provided a second element 35 which is a tubular member 36 with a cap 37. The tubular member 36 can be installed into the opening through the paper roll 22 and the cap 37 extends a substantial width. When that is installed, it is used to provide a more sure securing of the paper roll 22; and the cap 37 is held in place, as shown in FIG. 6, by the expanded finials 27, 28, 29, and 30.

The sizes, of course, of this device will depend upon the rolls for which it is designed to be used. Preferably, the separation of the four strip portions 23, 24, 25, and 26 begins at about 2½ inches from the end, or about 9 inches from the base 11 of a product where the standard 15 is about 11½ inches and the total length of the device, including the thickness of the base, about one foot. The finials 27, 28, 29, and 30 form lips about one-quarter of an inch wide. The plastic strips 16, 17, 18, and 19 are preferably one-eighth inch thick, preferably the base 11 is about 3 inches in diameter and about one-eighth of an inch thick. The top tubular member 35 has a cap 37, preferably four inches wide, and the portion 36 may be as long as 11 inches long, or shorter if desired.

The installation, when two members are used, may be done by first inserting the tubular member 35 into the core 21 and then pushing the standard 15 through the member 35. The rounded outer portions of the finials 27, 28, 29, and 30 help to guide them. The end portions compress and then snap out over the end to retain the roll.

The holder can be placed anywhere. Either adhesive or screws or both can be used. The member 10 may be secured to a counter either extending upwardly from the top of the counter or downwardly from the bottom of the counter. It may be secured to a wall or other vertical member, either above or below a counter or in a place away from any counter.

When the device is made for the use of toilet paper instead of tower, it is simply made smaller and the total length would be slightly less than 5 inches and the top tube only about 2 inches long.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A holder for paper towels, including in combination:

a base having two opposite generally flat surfaces, a standard extending from said surface of said base and integral therewith and having a major portion comprising a series of radially outwardly-extending flat strips extending out at intervals from a juncture at a common center line, all the strips being of identical radial extent along any intersecting plane parallel to said base, the outer edges of all strips tapering in the same manner from a widest portion at the base to a narrow portion distant from the base, and a minor portion distant from the base and comprising an extension of each of the strips with them separated from each other at the center by a distance increasing with the distance from the base, so that the strips of said minor portion may be forced in toward the center with springy resilience tending to restore them to a normal outward position, each said strip terminating at an out-turned finial, whereby a roll of paper can be placed on the standard by urging the finials inward and then pushing the paper roll toward the base until the finials emerge from the opposite end of the roll and by spring-action expand to overlie and engage that end of the paper roll and retain it in place on the standard.

2. A holder for paper towels, including in combination:

a base having two opposite generally flat surfaces, a standard extending from one of said surfaces of said base and integral therewith and having a major portion comprising a series of radially outwardly-extending strips extending out at intervals from a common center, all the strips being of identical radial extent along any intersecting plane parallel to said base, the outer edges of all strips tapering in the same manner from a widest portion at the base to a narrow portion distant from the base, and a minor portion distant from the base and comprising an extension of each of the strips with them separated from each other at the center by a distance increasing with the distance from the base, so that the strips of said minor portion may be forced in toward the center with springy resilience tending to restore them to a normal outward position, each said strip terminating at an out-turned finial, and a tubular member with an oversize cap for installation into a paper roll, with the cap at one end, so that the standard can be mounted thereinto, whereby a roll of paper with said tubular member inserted into one end to engage the cap therewith, can be placed on the standard by urging the finials inward and then pushing the other end of the paper roll toward the base until the finials pass through said tubular member and emerge from the opposite end of the roll and by spring-action expand to overlie and engage said oversize cap at that end of the paper roll and retain said roll in place on the standard.

3. The device of claim 1 wherein there are four said strips.

4. A holder for paper towels, including in combination:

a generally flat base and standard extending out from said base and integral therewith and having a major portion comprising four radially outwardly-extending flat radial strips extending out at ninety-degree intervals from juncture at a common center line, all the strips being planar and of identical radial extent along any intersecting plane parallel to said base, the outer edges of all strips tapering in the same manner from a widest portion at the base to a narrow portion distant from the base, and a minor portion distant from the base and comprising an extension of each of the four strips with them separated from each other at the center by a distance increasing with the distance from the base, so that the strips of said minor portion may be forced in toward the center with springy resilience tending to restore them to a normal outward position, each strip terminating at an out-turned finial, whereby a roll of paper can be placed on the standard by urging the finials inward and then pushing the paper roll toward the base until the finials emerge from the opposite end of the roll and by spring-action expand to overlie and engage that end of the paper roll and retain it in place on the standard.

5. The holder of claim 4 having a tubular member with an oversize cap for installation into a paper roll with the cap outside and bearing against one end of said paper roll, so that when said paper roll is installed on said standard, the tubular member is engaged by said standard and the expanded finials abut said cap.

* * * * *